US012006180B2

(12) United States Patent
Stewart

(10) Patent No.: US 12,006,180 B2
(45) Date of Patent: Jun. 11, 2024

(54) APPARATUS AND METHOD FOR SPLITING A TOW OF CARBON FIBER FILAMENTS

(71) Applicant: Charles Fletcher Stewart, Athens, TN (US)

(72) Inventor: Charles Fletcher Stewart, Athens, TN (US)

( * ) Notice: Subject to any disclaimer, the term of this patent is extended or adjusted under 35 U.S.C. 154(b) by 167 days.

(21) Appl. No.: 17/891,574

(22) Filed: Aug. 19, 2022

(65) Prior Publication Data

US 2023/0211974 A1 Jul. 6, 2023

Related U.S. Application Data

(60) Provisional application No. 63/296,329, filed on Jan. 4, 2022.

(51) Int. Cl.
*B65H 51/005* (2006.01)
*B65H 54/20* (2006.01)
*B65H 59/40* (2006.01)

(52) U.S. Cl.
CPC ..... *B65H 51/005* (2013.01); *B65H 54/20* (2013.01); *B65H 59/40* (2013.01); *B65H 2301/51422* (2013.01); *B65H 2301/515326* (2013.01); *B65H 2301/5155* (2013.01); *B65H 2701/314* (2013.01)

(58) Field of Classification Search
CPC .. D02G 3/16; B65H 2701/314; B65H 51/005; B65H 51/01; D02J 1/18; D02J 1/20; D02J 1/223; D02J 1/222; D01D 11/02
USPC ..... 28/283
See application file for complete search history.

(56) References Cited

U.S. PATENT DOCUMENTS

| | | | | |
|---|---|---|---|---|
| 3,358,436 | A * | 12/1967 | Niina | D06M 10/00 57/232 |
| 6,385,828 | B1 | 5/2002 | Kiss | |
| 10,570,536 | B1 | 2/2020 | Faulkner | |
| 2002/0123819 | A1 | 9/2002 | Baudry et al. | |
| 2005/0195270 | A1 | 9/2005 | Shih et al. | |
| 2006/0085958 | A1* | 4/2006 | Oishibashi | B65H 51/005 28/282 |
| 2012/0298319 | A1 | 11/2012 | Fujiwara et al. | |
| 2016/0333507 | A1 | 11/2016 | Nagata et al. | |
| 2016/0355976 | A1* | 12/2016 | Zhao | D07B 1/02 |
| 2019/0047247 | A1 | 2/2019 | Lima et al. | |
| 2019/0070797 | A1* | 3/2019 | Helms | D02G 3/402 |

OTHER PUBLICATIONS

Sharif et al, Forming low-cost, high quality carbon tows for automotive application, IOP Conference Series: Materials Science and Engineering, Sep. 2018.
Mader, Thomas & Trautmann, Maik & Nestler, Daisy & Wielage, Bernhard. Continuous splitting of carbon fibre rovings. Journal of Industrial Textiles. Jul. 30, 2014.
Malnati, Split tow carbon fiber boosts SMC performance, CompositesWorld, Jun. 12, 2019.

* cited by examiner

*Primary Examiner* — Jillian K Pierorazio

(57) ABSTRACT

An apparatus and method for splitting a high filament count carbon fiber tow into a set of tows with reduced filament counts. The apparatus is comprised of an electrolyte bath assembly and a splitting assembly comprised of at least one blade. The preferred embodiment of the blades being Polytetrafluoroethylene (PTFE). The splitting assembly being positioned within the electrolyte bath or adjacent to the exit of the electrolyte bath.

20 Claims, 9 Drawing Sheets

APPARATUS AND METHOD FOR SPLITING A TOW OF CARBON FIBER FILAMENTS

FIELD OF THE INVENTION

The present invention relates generally to carbon fiber. More specifically, the present invention relates to an apparatus and method for splitting a tow of carbon fiber from a high filament count into lower filament counts.

BACKGROUND OF THE INVENTION

Carbon fibers are fibers composed mostly of carbon ranging from 5 to 10 micrometers (0.00020-0.00039 in) in diameter. Carbon fibers offer many advantages including high stiffness, high tensile strength, low weight to strength ratio, high chemical resistance, high-temperature tolerance, and low thermal expansion. These properties have made carbon fiber very popular in aerospace, civil engineering, military, automotive, and motorsports applications.

Carbon fiber is created by converting a precursor fiber into carbon. These precursor fibers are a significant cost of manufacturing carbon fiber. As a means of reducing costs, research is being done to utilize less expensive precursor fibers. These less expensive precursor fibers can reduce the final cost of carbon fibers by roughly a third or more. Production using these economical precursor fibers currently results in thick tows with filament counts as high as 300,000 (300K, where "K" means 1,000) or higher.

While these thick tows are economical to produce, most applications require tows of a much lower filament count. As an example, some automotive parts utilize 50K filament count tows, while some aerospace applications require thin tows of 3K filament count. This creates a need for a method and apparatus for converting these thick economical tows down to the thinner tows used by most applications. Current methods and systems for splitting tows have known issues, such as filament tangling, fiber tearing or breakage, and fiber fuzz. Further, these known issues like tearing or breakage can lead to inconsistent tows, where the mass is not uniform over their length or varies from tow to tow. This can lead to weak spots when the tow is manufactured into a final product.

Therefore, there is a need for improved methods and systems for splitting carbon fiber tows that overcome the above-mentioned issues.

SUMMARY OF THE INVENTION

According to some embodiments, an apparatus and method of splitting carbon fiber filament tows is disclosed. The present invention is capable of being utilized in line with the initial production of the carbon fiber as well as being able to split carbon fiber from a previous production. The simplicity of the design also allows for easy setup and troubleshooting.

The present invention is comprised of a splitting assembly which utilizes Polytetrafluoroethylene (PTFE) or equivalent material blades to split the carbon fiber tow. This splitting process is performed within or at the exit of the electrolyte bath assembly.

The combination of the design and location of the splitting assembly within the electrolyte bath assembly has significant advantages. Some advantages being that the electrolyte fluid provides a lubricating effect, the static charge built up on the blades help to split the fiber, and the electrical current in the electrolyte bath helps consolidate and bond the split tows.

DETAILED DESCRIPTION OF THE INVENTION

Figure 1:
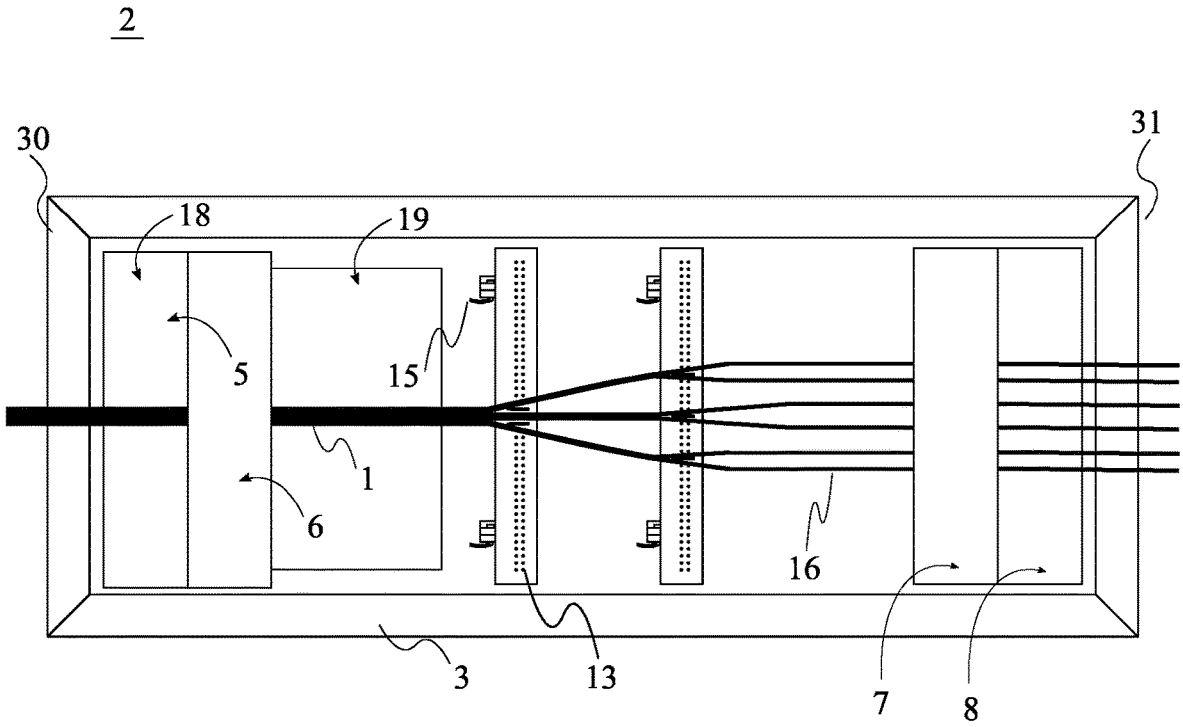
FIG. 1 is a top plan view of the present invention with the splitting assemblies mounted within the bath basin.

All illustrations of the drawings are for the purpose of describing selected versions of the present invention and are not intended to limit the scope of the present invention.

The present invention is an apparatus and method for splitting or dividing a carbon fiber tow from a heavy tow 1 (a high filament count tow) into a number of split tows 16 (lower filament count tows).

Lower cost textile grade precursor fibers are starting to be used to manufacture carbon fiber, significantly decreasing the cost of carbon fiber. The fiber tows (or bundles) created by these methods are thick having filament counts of 300,000 (300K, K meaning 1,000) or higher. While these large or heavy tows are good for cost, they are too high of a filament count for most applications. Examples of typical tows for some applications would be a 50K tow for an automotive part, or a 3K tows for an aerospace part. The present invention allows for the splitting of these heavy tows 1 down into the desired sized tow. The present invention can be used in-line with the manufacture of new carbon fiber. Alternately, the present invention may also be used with carbon fiber that has been previously manufactured, by first stripping off any sizing agent or coating, then processing through the invention.

The preferred embodiment of the present invention is comprised of an electrolyte bath assembly 2, and a splitting assembly 9. The electrolyte bath assembly 2 is further comprised of a bath basin 3, an electrolyte fluid 4, an upper entry roller 5, a lower entry roller 6, a lower exit roller 7, an upper exit roller 8, an anode 18 and a cathode 19.

The bath basin 3 is a basin which contains the electrolyte fluid 4 of which there are several types but in the preferred embodiment, the electrolyte fluid 4 is comprised of an ammonia solution commonly used for carbon fiber manufacturing.

The bath basin 3 has an entry end 30 and an exit end 31. The entry end 30 of the bath basin 3 is the side where a heavy tow 1 enters the electrolyte bath assembly 2. The exit end 31 is the side where the fiber tow would exit the electrolyte bath assembly 2.

The function of the entry rollers is to guide a heavy tow 1 into the bath basin 3, and there are many possible of designs for the entry rollers of the present invention. Some designs are as simple as a single roller which guides the heavy tow 1 into the bath basin 3. The preferred embodiment is designed with two entry rollers. The upper entry roller 5 is positioned adjacent to the entry end 30 with the top of the upper entry roller 5 positioned above the top lip of the bath basin 3. The lower entry roller 6 is positioned adjacent to the entry end 30 with the bottom of the roller positioned below the surface of the electrolyte fluid 4 within the bath basin 3.

The function of the exit rollers is to guide the fiber tow out of the bath basin 3, and there are many possible of designs for the exit rollers of the present invention. Some designs are as simple as a simple as a single roller which guides the fiber tow out of the bath basin 3. The preferred embodiment is designed with two exit rollers. The upper exit roller 8 is positioned adjacent to the exit end 31 with the top of the upper exit roller 8 positioned above the top lip of the bath basin 3. The lower exit roller 7 is positioned adjacent to the exit end 31 with the bottom of the roller positioned below the surface of the electrolyte fluid 4 within the bath basin 3.

An anode is a device that is positively charged by an electrical source, whereas a cathode is a device that is negatively charged by an electrical source. In the preferred embodiment, the upper entry roller 5 also serves the function of being an anode 18. The upper entry roller 5 is positively charged using an electrical power source. The heavy tow 1, being an electrically conductive material picks up and carries this positive charge created by the anode 18. The cathode 19 in the preferred embodiment takes the form of a plate that is submerged in the electrolyte fluid 4 within the bath basin 3.

The preferred embodiment of the present invention is further comprised of the splitting assembly 9 which is comprised of at least one blade 10, blade pins 11, a base plate 12, a set of base plate supports 14, and a set of locking hinges 15.

Figure 3:
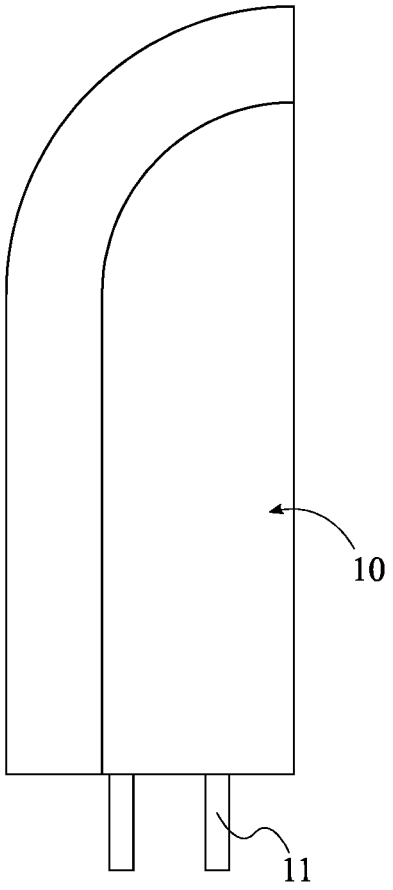
FIG. 3 is a front elevation view of a blade with blade pins of the present invention.
Figure 4:
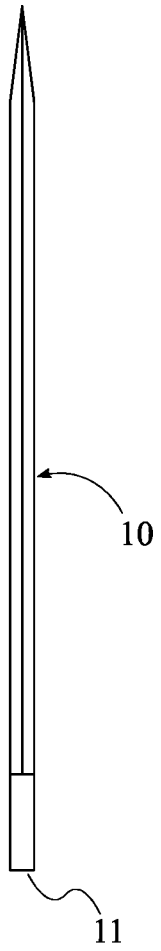
FIG. 4 is a left elevation view of a blade with blade pins of the present invention.
Figure 5:
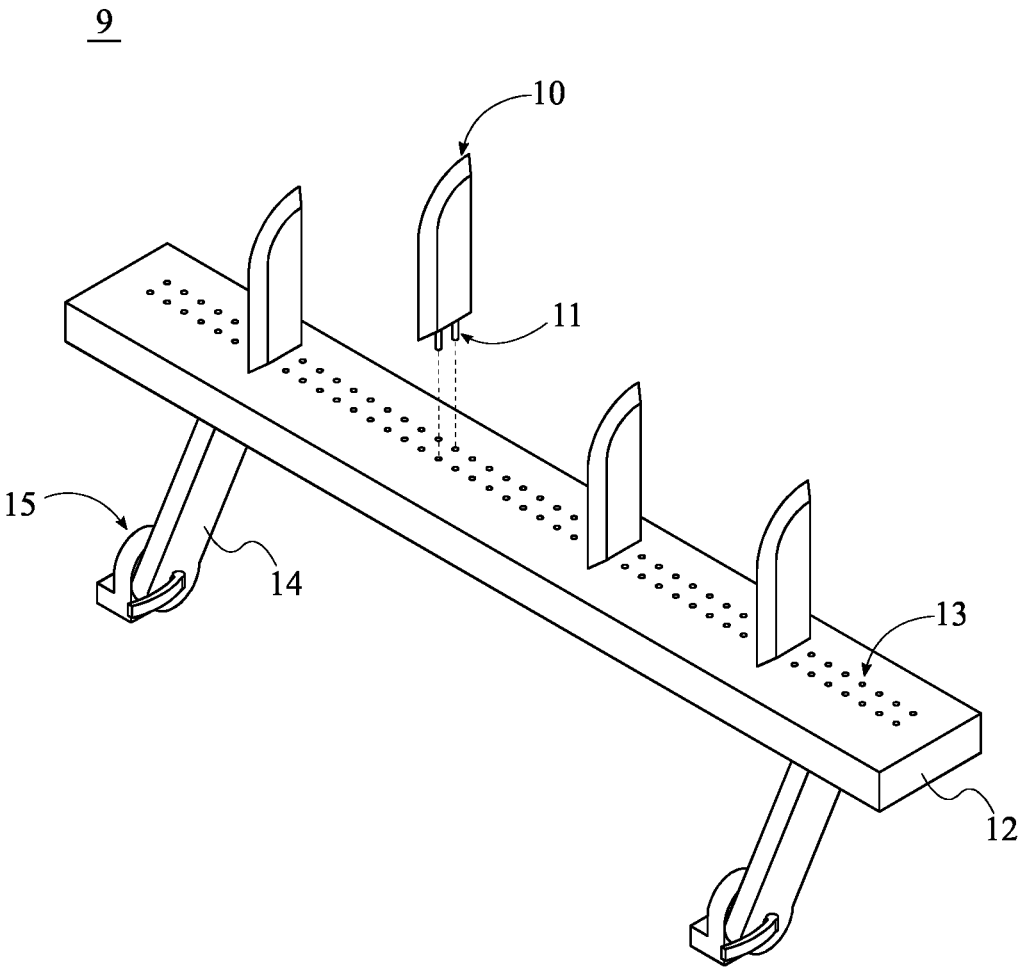
FIG. 5 is an exploded front-top perspective view showing a splitting assembly of the present invention with an exploded view illustrating the mounting of a blade.

As shown in FIG. 5, in the preferred embodiment the base plate 12 is used to position each blade 10. The base plate 12 having a pattern of holes 13, which correspond to preferred blade 10 positions. As shown in FIG. 3, the preferred embodiment uses blades 10 with blade pins 11. These blade pins 11 extend out of the bottom of each blade 10. As shown in FIG. 5, in the preferred embodiment the blade pins 11 match up with the pattern of holes 13 in the base plate 12, so that the blade pins 11 may be inserted into the holes 13 and the blade 10 would be held in the desired position and orientation. This embodiment allows for blades 10 to be added, removed, or moved as needed. In other embodiments other means of mounting the blades 10 to the base plate 12 may be used, including but not limited to slots, bolts, or welding.

As shown in FIG. 5, in the preferred embodiment the base plate 12 is held in position by a set of base plate supports 14 which are attached to the base plate 12 using any suitable means such as welding or bolting. The base plate supports 14 can have any shape as needed to support the base plate 12 and blades 10 in the desired position and orientation. The preferred embodiment also has a set of locking hinges 15 attached to the base plate supports 14 and are used to mount the splitting assembly 9 into its desired location. These locking hinges 15 also allow the splitting assembly 9 to be rotated up or down when unlocked. Further, when locked the locking hinges 15 fix the splitting assembly 9 in the desired position.

Figure 2:
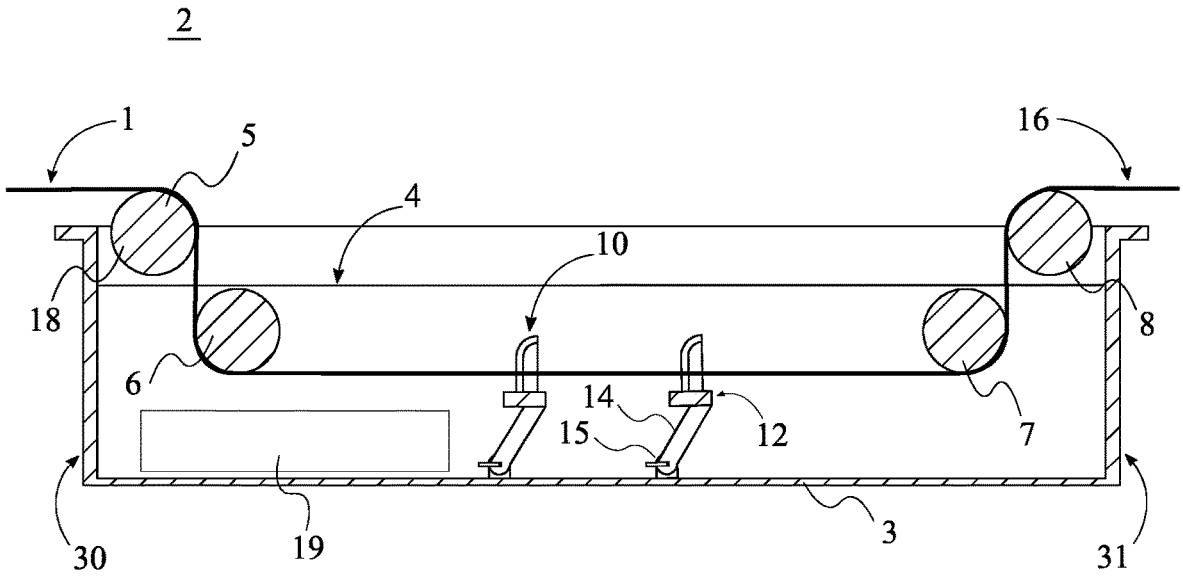
FIG. 2 is a cross sectional front elevation view of the present invention with the splitting assemblies mounted within the bath basin.

As shown in FIGS. 1 and 2, in one preferred embodiment the splitting assembly 9 is mounted within the bath basin 3 in line between the lower entry roller 6 and the lower exit roller 7. The blade 10 of the splitting assembly 9 being positioned and oriented in line with the towpath inside the bath basin 3.

Figure 6:
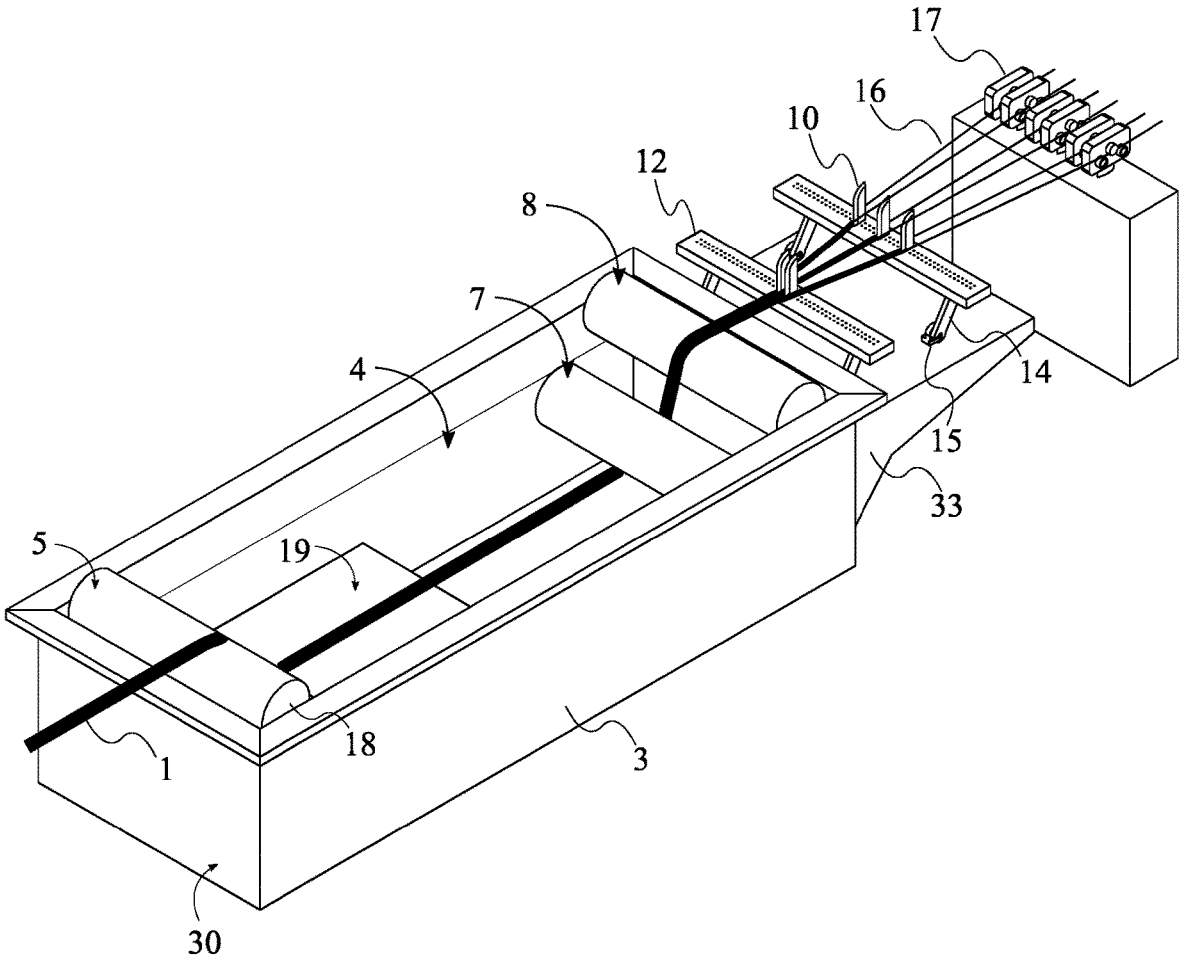
FIG. 6 is a left-top perspective view of the present invention with the splitting assemblies mounted outside of the bath basin adjacent the exit end, further including an array of tension sensors.

As shown in FIG. 6, in another preferred embodiment the splitting assembly 9 is mounted outside of the bath basin 3, adjacent to the exit end 31 and in line with the lower entry roller 6 and the lower exit roller 7. The blade 10 of the splitting assembly 9 being positioned and oriented in line with the towpath so as the heavy tow 1 is feed out of the exit end 31 of the bath basin 3, the blades 10 engage and split the heavy tow 1. The embodiment shown in FIG. 6 utilizes a splitting assembly support 33, but any suitable means of mounting the splitting assembly 9 outside of the bath basin 3 may be used.

In the present invention, blades 10 may be created in a variety of shapes and sizes based the application and the equipment used. Blade 10 height can vary but needs to be tall enough to engage the heavy tow 1 and keep the split tows 16 separated. The leading edge of each blade 10 is beveled to a knife-edge, this knife-edge being used to split the heavy tow 1.

Further embodiments of the blade 10 can take varied shapes, such a disc blade 32. The blade 10 shape is not limited by the preferred embodiment as many shapes can be created with a knife-edge and similar properties to the preferred embodiment.

The present invention uses a blade 10 that is constructed of a smooth material that is capable of splitting the tow without cutting or tearing the filaments. In the preferred embodiment, the blade 10 is created from Polytetrafluoroethylene or PTFE. PTFE is used because of its low surface roughness and smooth surface. PTFE is also an electrical insulator which allows it to build up and hold a static charge. This static charge repeals the filaments and improves the splitting of the heavy tow 1 into split tows 16.

Other embodiments may be created from other smooth materials such as porcelain or other materials with equivalent smoothness. In some embodiments the blades 10 may be made of a base material that is coating with PTFE, porcelain, or equivalent material.

PTFE has a further advantage of not reacting with the elements of the electrolyte bath assembly 2. If the blades 10 were made of metal, it may react with the electrolyte bath causing pits or build ups that could lead to tearing and destroying filaments.

In some embodiments, after the split tows 16 exit the splitting assembly 9, the split tows 16 are feed into an array of tension sensors 17. The array being positioned after the exit end 31 of the bath basin 3. The array of tension sensors 17 having a corresponding tension sensor that is mounted in line with the towpath of each split tow 16. Each split tow 16 would be feed into a tension sensor 17 that would then detect the tension on each split tow 16. This tension data would then be correlated to a filament count for each split tow 16. Further, if any tension changes are detected, the operator may be alerted of a possible process change.

In further embodiments, a vision system or an array of vision systems can be used in place of the array of tension sensors 17. The vision system would be capable of visually measure the size of the split tow 16 and correlating the visual size measurement of the split tow 16 to a filament count.

Figure 7:
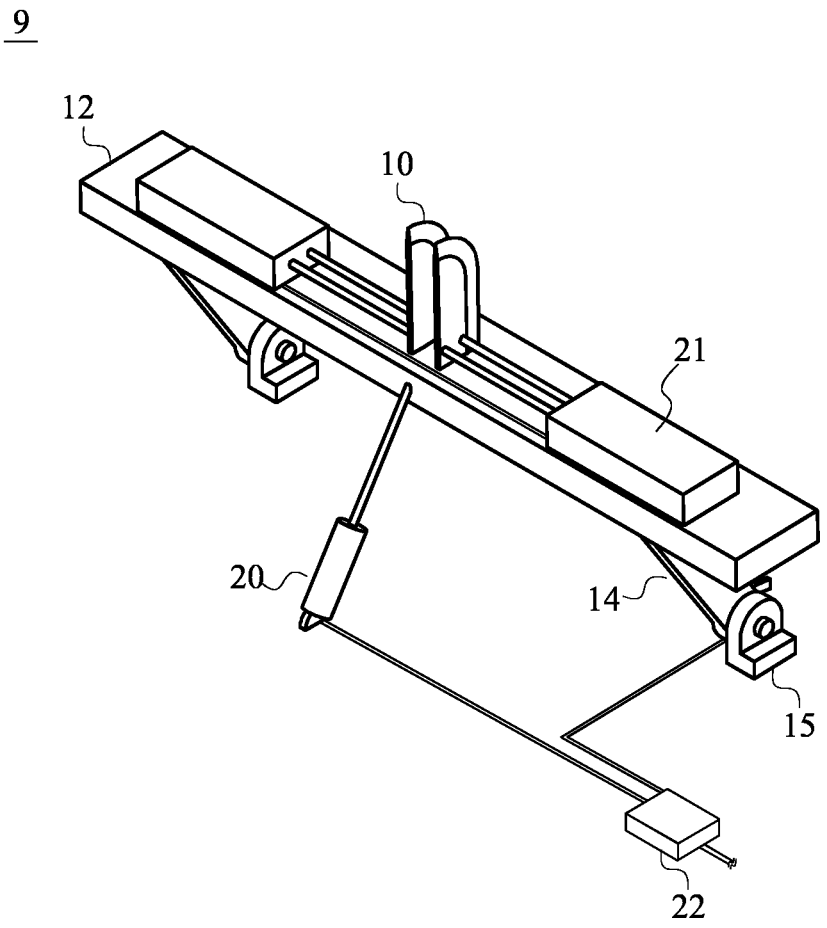
FIG. 7 is a rear-top prospective view of a splitting assembly including base plate actuator in the extended position, blade actuators in the extended position, and communication device of the present invention.
Figure 8:
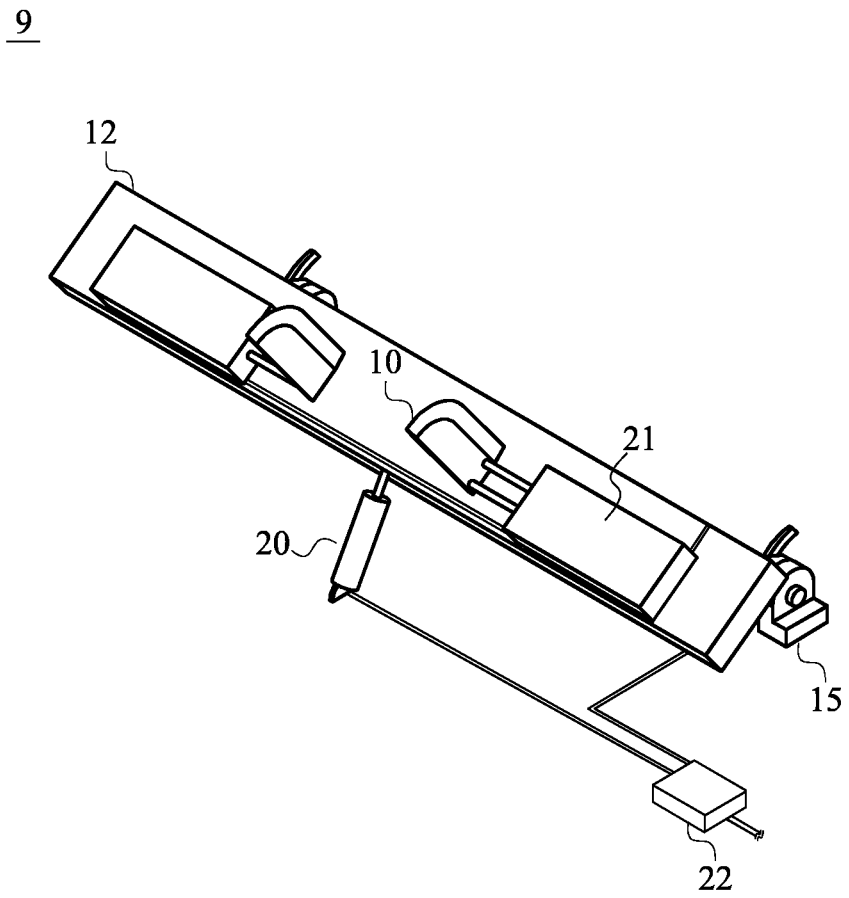
FIG. 8 is a rear-top prospective view of a splitting assembly including base plate actuator in the contracted position, blade actuators in the retracted position, and communication device of the present invention.
Figure 9:
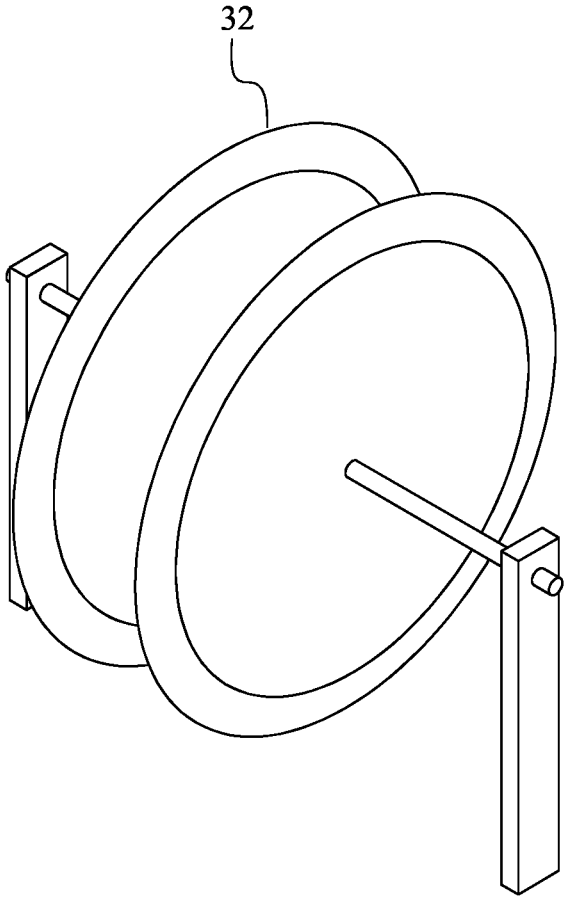
FIG. 9 is a front-right prospective view of a set of two disc shaped blades of the present invention.

As shown in FIGS. 7 and 8, in further embodiments of the present invention, the splitting assembly 9 may be further comprised of a base plate actuator 20, blade actuators 21, and a communication device 22. The base plate actuators 20, blade actuators 21, and the communication device 22 are communicatively linked.

The base plate actuator 20 being pivotally mounted to an adjacent solid surface and being pivotally attached to the base plate 12, so that as the base plate actuator 20 extends it pushes the base plate 12 upward and forwards, and when the base plate actuator 20 is contracted it pulls the base plate 12 backwards and downward.

The blade actuators 21 being mounted to the base plate 12 and the blade 10 being fixed to the blade actuator 21, so that when the actuator is extended in a first direction, the blade 10 is moved in the first direction, and when the blade actuator 21 is retracted in a second direction, the blade 10 is moved in the second direction.

The communication device 22 is configured for receiving a signal from at least one user device associated with at least one user. Said signal may be associated with a positioning command for the desired position for the blade 10 and splitting assembly 9. The communication device 22 transmits the signal corresponding to the desired position to the base plate actuator 20 and the blade actuators 21. The actuators then adjust the position the splitting assembly 9 and blades 10 to the desired position as indicated by the signal.

The system may further include a processing device communicatively coupled with the communication device 22. The processing device may be configured for analyzing the signal and generating the signal transmitted to the base plate actuator 20 and the blade actuators 21.

The present invention is further comprised of a method for splitting a carbon fiber tow. After obtaining a heavy tow 1 of carbon fiber with a high filament count, the heavy tow 1 is fed into the electrolyte bath assembly 2.

In the preferred method the heavy tow 1 is feed under tension into the entry end 30 of the bath basin 3. The heavy tow 1 first wrapping over the top of the upper entry roller 5 making a 90-degree bend downward into the electrolyte fluid 4 inside the bath basin 3. The heavy tow 1 next wraps under the lower entry roller 6 making a 90-degree bend and feeds horizontally beneath the surface of the electrolyte fluid 4.

The fiber tow feeds through the bath basin 3 until it reaches the exit end 31, where the fiber tow wraps underneath the lower exit roller 7 and makes a 90-degree bend upward. The fiber tow then feeds upward and wraps over top of the upper exit roller 8, making a 90-degree bend and feeding horizontally away from the exit end 31 of the bath basin 3.

With the heavy tow 1 being feed through the electrolyte bath assembly 2 under tension, a first splitting assembly 9 is positioned and oriented to engage the towpath of the heavy tow 1. The heavy tow 1 is split using the blade 10 so that a split tow 16 is produced on either side of the blade 10 containing a reduced filament count. If the first splitting assembly 9 contains more than one blade 10, the heavy tow 1 is split by each blade 10 so that more split tows 16 are created as more blades 10 are added.

As shown in FIGS. 1 and 6, further method embodiments can include the use of multiple splitting assemblies 9. As an example, a second splitting assembly 9 is positioned and oriented to engage the towpath of the split tows 16 produced by the first splitting assembly 9. Further splitting assemblies 9 maybe be added lined up in layers, each splitting assembly 9 behind the previous. Each layer producing further reduced filament count split tows 16 as needed to achieve the desired filament count.

As shown in FIGS. 1 and 2, in one preferred method the splitting assembly 9 is mounted within the bath basin 3 underneath the surface of the electrolyte fluid 4. The blade 10 of the splitting assembly 9 is positioned and oriented in line with the towpath so as the heavy tow 1 is split into split tows 16 inside the bath basin 3.

As shown in FIG. 6, in another preferred method the splitting assembly 9 is mounted outside of the bath basin 3 adjacent to the exit end 31. The blade 10 of the splitting assembly 9 is positioned and oriented in line with the towpath so as the heavy tow 1 is feed out of the exit end 31 of the bath basin 3, the heavy tow 1 is split into split tows 16.

As shown in FIG. 6 further methods include the use of an array of tension sensors 17, to measure the tension on each split tow 16. The array of tension sensors 17 is positioned adjacent to the exit end 31 of the bath basin 3. As the split tow 16 is feed through the tension sensor 17, the tension is measured. The tension measurement from each split tow 16 is then correlated to a corresponding split tow 16 filament count. Further, if a tension sensor 17 detects a change in the tension on any of the split tows 16 the operator can be alerted to a possible process change or quality issue.

While the fiber tow is within the bath basin 3 and under the surface of the electrolyte fluid 4, an electrolysis treatment is performed on the fiber tow. In the preferred method the electrolysis treatment is performed by having the upper entry roller 5 function as an anode 18 having a positive charge that is applied to the heavy tow 1. Due to the electrical conductivity of carbon fiber, the heavy tow 1 carries the positive charge, which makes the heavy tow act as an anode. The cathode 19 applies a negative charge to the electrolyte fluid 4 within the bath basin 3.

As the positively charged heavy tow 1 is feed through the negatively charged electrolyte fluid 4, the charge difference between the anode 18 and the cathode 19 ionizes carbon atoms within the electrolyte fluid 4. These carbon ions bond to the fiber tow and create bonds between the carbon fiber filaments, creating a stronger tow that resists breaks. This process of forming creating bonds is the electrolysis treatment.

One advantage of the present invention is that since the split tow 16 are either inside the bath basin 3, or still coated in electrolyte fluid 4 at the exit of the bath basin 3, bonds are still being created. Therefore, any loose fibers created during splitting are bonded to the split tow 16, creating a consolidated, bonded split tow 16.

As shown in FIGS. 7 and 8, in further methods, the splitting assembly 9 can be moved with the use of a base plate actuator 20 and blade actuators 21. The splitting assembly 9 being in line with the heavy tow 1, can be raised by extending the base plate actuator 20. The raised splitting assembly 9 is now in position to split the heavy tow 1. Further the splitting assembly 9 can be lowered by retracting the base plate actuator 20, the lowered splitting assembly 9 would be disengaged from the heavy tow 1 and would not be splitting.

The position of the blades 10 can also be moved using blade actuators 21. The blades 10 are attached to the end of the blade actuators 21 so as the blade actuators 21 extend and retract the blades 10 move horizontally across the base plate, similar to moving hole positions. The blade actuators 21 are now able to position the blades 10 using the extension of the blade actuators 21 and position the blades 10 in the correct location on the cross section of the heavy tow 1 to split it into split tows 16 of the desired filament count.

The addition of actuators allows the splitting assembly 9 to be lowered, to disengage the heavy tow 1. Then the blade 10 position can be adjusted to the desired position to achieve the desired filament count. Then the splitting assembly 9 can be raised to engage and split the heavy tow 1 into split tows 16 of the desired filament count. In this fashion positioning of the splitting assemblies are electronically controlled or automated.

Further methods include a communication device 22 being configured to receive a signal from at least one user device associated with at least one user. The signal being associated with the desired position for the splitting assembly 9 and blades 10. The communication device 22 being communicatively linked to the base plate actuator 20 and the blade actuators 21, transmits the signal according to the desired position of splitting assembly 9 to the base plate actuator 20, and the desired position of the blades 10 to the blade actuator 21. The base plate actuator 20 then extends or retracts in order to position the splitting assembly 9 into the desired position. Further, the blade actuators 21 extend to position the blades 10 into the desired position.

The splitting process of the present invention contains advantages including but not limited to the examples disclosed below. One advantage being that the electrolyte liquid 4 acts as a lubricant, helping the fibers to split and separate with minimal tearing and damage, thereby maintaining a uniform split tow 16 with a consistent filament count over its length.

Another advantage is that the charge difference between the anode 18 and cathode 19 helps the fiber tow attract loose fibers and helps to consolidate the split tow 16 after the splitting process.

A further advantage of splitting inside the bath basin 3 is that any loose filaments are pulled toward the split tow 16 by drag cause by the tow moving through fluid. If the splitting occurs outside of the bath basin 3, then the surface tension of the electrolyte fluid 4 remaining on the split tow 16, helps pull loose filaments towards the split tow 16.

Further embodiments of the present invention may be comprised without any base plates 12, instead the blade 10 is positioned and oriented by an alternate means such as welding or bolting directly to the bath basin 3.

Further embodiments may have multiple heavy tows 1 that are feed through the electrolyte bath assembly 2 at the same time. These multiple tows may be split using a single splitting assembly 9 or separate splitting assemblies 9, arranged are need. Some further embodiments may have one or more splitting assemblies 9 mounted inside the bath basin 3 along with one or more splitting assemblies mounted adjacent to the exit end 31 of the bath basin 3.

Although the invention has been explained in relation to its preferred embodiment, it is to be understood that many other possible modifications and variations can be made without departing from the spirit and scope of the invention.

Further the present invention is capable of being used during other stages in the manufacture of carbon fiber. In one embodiment, a sizing agent treatment is applied to the carbon fiber tow using a sizing treatment assembly comprised of an entrance roller, an exiting roller, and a sizing tub. The sizing tub having an entrance end and an exiting end. The entrance roller being mounted inside the sizing tub adjacent to the entrance end. The exiting roller being mounted inside the sizing tub adjacent to the exiting end.

The sizing treatment assembly is further comprised of a splitting assembly or assemblies. The splitting assembly are positioned either inside of the sizing tub between the entrance and exiting rollers or outside of the sizing tub adjacent to the exiting end.

The sizing agent treatment embodiment would have a first method of use where the splitting assembly or assemblies are positioned inside of the sizing tub between the entrance and exiting rollers. The carbon fiber tow would enter the sizing treatment assembly being guided into the sizing tub using the entrance roller. The splitting assembly would split the carbon fiber tow from a high filament count into tows with a reduced filament count. The tows with a reduced filament count would then be guided out of the sizing tub using the exiting roller.

The sizing agent treatment embodiment would have a second method of use where the splitting assembly or assemblies are positioned outside of the sizing tub adjacent to the exiting end. The carbon fiber tow would enter the sizing treatment assembly being guided into the sizing tub using the entrance roller. The tow would then be guided out of the sizing tub using the exiting roller. Then the splitting assembly would split the carbon fiber tow from a high filament count into tows with a reduced filament count.

What is claimed is:

1. A carbon fiber tow splitting apparatus, comprising:
- an electrolyte bath assembly;
- a bath basin;
- at least one entry roller;
- at least one exit roller;
- a splitting assembly;
- at least one blade;
- the electrolyte bath assembly comprising the bath basin, the at least one entry roller, and the at least one exit roller;
- the bath basin having an entry end, and an exit end;
- the at least one entry roller being positioned within the bath basin adjacent to the entry end;
- the at least one exit roller being positioned within the bath basin adjacent to the exit end;
- the splitting assembly comprising the at least one blade; and
- the splitting assembly being positioned in line with the at least one entry roller and the at least one exit roller.

2. The carbon fiber tow splitting apparatus as claimed in claim 1 comprises:
- the splitting assembly is further comprised of a base plate, a set of base plate supports, and a set of locking hinges;
- the at least one blade being attached to the base plate;
- the base plate being attached to the set of base plate supports; and
- the set of base plate supports being attached to the set of locking hinges.

3. The carbon fiber tow splitting apparatus as claimed in claim 2 comprises:
- the electrolyte bath assembly is further comprised of an array of tension sensors; and
- the array of tension sensors being mounted outside of the bath basin adjacent the exit end of the bath basin.

4. The carbon fiber tow splitting apparatus as claimed in claim 2 comprises:
- the splitting assembly is mounted within the bath basin.

5. The carbon fiber tow splitting apparatus as claimed in claim 2 comprises:

the splitting assembly is mounted outside of the bath basin adjacent the exit end of the bath basin.

6. The carbon fiber tow splitting apparatus as claimed in claim 2 comprises:

the splitting assembly is further comprised of a base plate actuator, a blade actuator, and a communication device communicatively linked to the base plate actuator and the blade actuator.

7. The carbon fiber tow splitting apparatus as claimed in claim 1 comprises:

the at least one blade is created from Polytetrafluoroethylene.

8. The carbon fiber tow splitting apparatus as claimed in claim 1 comprises:

the at least one blade is disc shaped.

9. A method of splitting a carbon fiber tow, comprising:

obtaining a carbon fiber tow with a high filament count;

feeding the carbon fiber tow into an electrolyte bath assembly;

guiding the carbon fiber tow into an entry end of a bath basin using at least one entry roller;

feeding the carbon fiber tow through a first splitting assembly comprised of at least one blade;

splitting the carbon fiber tow into a set of split tows with a reduced filament count using the at least one blade; and guiding the set of split tows out of an exit end of the bath basin using at least one exit roller.

10. The method of splitting a carbon fiber tow as claimed in claim 9 comprises:

positioning the first splitting assembly within the bath basin.

11. The method of splitting a carbon fiber tow as claimed in claim 10 comprises:

positioning a second splitting assembly within the bath basin adjacent to the first splitting assembly; and splitting the set of split tows using the second splitting assembly.

12. The method of splitting a carbon fiber tow as claimed in claim 10 comprises: positioning an array of tension sensors adjacent to the exit end of the bath basin; feeding the set of split tows through the array of tension sensors wherein each tension sensor in the array of tension sensors is fed with one split tow from the set of split tows; and measuring a tension force on each of the set of split tows using the array of tension sensors.

13. The method of splitting a carbon fiber tow as claimed in claim 10 comprises: receiving a signal using a communication device; transmitting the signal via the communication device to a base plate actuator; adjusting the position of the first splitting assembly by adjusting the base plate actuator according to the signal.

14. The method of splitting a carbon fiber tow as claimed in claim 10 comprises: receiving a signal using a communication device; transmitting the signal via the communication device to a blade actuator; adjusting the position of the at least one blade by adjusting the blade actuator according to the signal.

15. A method of splitting a carbon fiber tow, comprising:

obtaining a carbon fiber tow with a high filament count;

feeding the carbon fiber tow into an electrolyte bath assembly;

guiding the carbon fiber tow into an entry end of a bath basin using at least one entry roller;

guiding the carbon fiber tow out of an exit end of the bath basin using at least one exit roller;

feeding the carbon fiber tow through a first splitting assembly comprised of at least one blade; and splitting the carbon fiber tow into a set of split tows with a reduced filament count using the at least one blade.

16. The method of splitting a carbon fiber tow as claimed in claim 15 comprises:

positioning the first splitting assembly outside of the bath basin adjacent to the exit end of the bath basin.

17. The method of splitting a carbon fiber tow as claimed in claim 16 comprises:

positioning a second splitting assembly outside of the bath basin adjacent to the first splitting assembly; and splitting the set of split tows using the second splitting assembly.

18. The method of splitting a carbon fiber tow as claimed in claim 16 comprises: positioning an array of tension sensors adjacent to the first splitting assembly; feeding the set of split tows through the array of tension sensors wherein each tension sensor in the array of tension sensors is fed with one split tow from the set of split tows; and measuring a tension force on each of the set of split tows using the array of tension sensors.

19. The method of splitting a carbon fiber tow as claimed in claim 16 comprises: receiving a signal using a communication device; transmitting the signal via the communication device to a base plate actuator; adjusting the position of the first splitting assembly by adjusting the base plate actuator according to the signal.

20. The method of splitting a carbon fiber tow as claimed in claim 16 comprises: receiving a signal using a communication device; transmitting the signal via the communication device to a blade actuator; adjusting the position of the at least one blade by adjusting the blade actuator according to the signal.

* * * * *